US006792895B2

(12) United States Patent
Kayahara et al.

(10) Patent No.: US 6,792,895 B2
(45) Date of Patent: Sep. 21, 2004

(54) COMBUSTION METHOD AND APPARATUS FOR $NO_X$ REDUCTION

(75) Inventors: Toshihiro Kayahara, Matsuyama (JP); Noboru Takubo, Matsuyama (JP)

(73) Assignee: Miura Co., Ltd., Ehime-ken (JP)

( * ) Notice: Subject to any disclaimer, the term of this patent is extended or adjusted under 35 U.S.C. 154(b) by 0 days.

(21) Appl. No.: 10/618,639

(22) Filed: Jul. 15, 2003

(65) Prior Publication Data

US 2004/0025805 A1 Feb. 12, 2004

(30) Foreign Application Priority Data

| | | |
|---|---|---|
| Jul. 15, 2002 | (JP) | 2002-205303 |
| Aug. 5, 2002 | (JP) | 2002-227378 |
| Aug. 5, 2002 | (JP) | 2002-227381 |
| May 20, 2003 | (JP) | 2003-141252 |

(51) Int. Cl.[7] ..... F22D 1/02
(52) U.S. Cl. ..... 122/7 R; 122/367.3
(58) Field of Search ..... 122/7 R, 17.1, 122/78, 367.1, 367.2, 367.3

(56) References Cited

U.S. PATENT DOCUMENTS

| | | | | |
|---|---|---|---|---|
| 5,199,384 A | * | 4/1993 | Kayahara et al. | 122/18.4 |
| 5,353,748 A | * | 10/1994 | Kayahara et al. | 122/18.4 |
| 6,029,614 A | * | 2/2000 | Kayahara et al. | 122/367.1 |
| 6,041,743 A | * | 3/2000 | Takubo et al. | 122/367.3 |

* cited by examiner

*Primary Examiner*—Gregory A. Wilson
(74) *Attorney, Agent, or Firm*—Birch, Stewart, Kolasch & Birch, LLP

(57) ABSTRACT

Combustion method and apparatus for $NO_x$ reduction which are capable of achieving $NO_x$ reduction with the value of exhaust $NO_x$ under 10 ppm, as well as CO reduction at the same time. The combustion method for fulfilling $NO_x$ reduction and CO reduction by suppressing temperature of combustion gas derived from a burner comprises a $NO_x$ reduction step for suppressing combustion gas temperature in such a manner that suppression of $NO_x$ generation is preferred to reduction of exhaust CO value, thereby keeping $NO_x$ value not more than a specified value, and a CO reduction step for thereafter reducing exhaust CO value resulting from the $NO_x$ reduction step to not more than a specified value.

18 Claims, 12 Drawing Sheets

COMBUSTION METHOD AND APPARATUS FOR $NO_X$ REDUCTION

BACKGROUND OF THE INVENTION

The present invention relates to a combustion method for $NO_x$ reduction, as well as an apparatus therefor, to be applied to water-tube boilers, reheaters of absorption refrigerators, or the like.

Generally, as the principle of suppression of $NO_x$ generation, there have been known (1) suppressing the temperature of flame (combustion gas), (2) reduction of residence time of high-temperature combustion gas, and (3) lowering the oxygen partial pressure. Then, various $NO_x$ reduction techniques to which these principles are applied are available. Examples that have been proposed and developed into practical use include the two-stage combustion method, the thick and thin fuel combustion method, the exhaust gas recirculate combustion method, the water addition combustion method, the steam jet combustion method, the flame cooling combustion method with water-tube groups, and the like.

With the progress of times, $NO_x$ generation sources even of relatively small capacity such as water-tube boilers have been coming under increasingly stricter regulation of exhaust gas, and so further reduction of $NO_x$ is demanded therefor. The present applicant proposed $NO_x$ reduction techniques for these demands by the Specification of U.S. Pat. No. 6,029,614 and the like.

However, the extent of $NO_x$ reduction by these prior arts is up to about 25 ppm actually, and there has not yet been developed so far any $NO_x$ reduction technique of under 10 ppm in practical use. It is noted that $NO_x$ reduction with the value of $NO_x$ generation being not more than 10 ppm will hereinafter be referred to as super $NO_x$ reduction.

The reason of that lies in that $NO_x$ reduction and CO reduction are contradictory technical issues. That is, if the combustion gas temperature is abruptly lowered to facilitate $NO_x$ reduction so that the temperature is suppressed to as low as 900° C. or less, a large amount of CO is generated and moreover the generated CO is discharged as it is unoxidized, with a result of increased CO emission. Conversely, if the combustion gas temperature is suppressed to a rather higher one in order to reduce the CO emission, the suppression of $NO_x$ generation becomes insufficient.

The $NO_x$ reduction technique proposed in the aforementioned prior art is also intended to suppress the combustion gas temperature so that the quantity of CO generated along with the $NO_x$ reduction is minimized, and that generated CO is oxidized. As a result of this, it has been the case that the prior art technique is limited in the selection of means for $NO_x$ reduction and poor in the suppression of combustion gas temperature, hence incapable of fulfilling the super $NO_x$ reduction.

SUMMARY OF THE INVENTION

An object of the present invention is to provide a combustion method for $NO_x$ reduction, as well as an apparatus therefor, capable of facilitating $NO_x$ reduction without requiring considerations of CO generation and easily achieving $NO_x$ reduction with the value of exhaust $NO_x$ under 10 ppm, and still capable of achieving CO reduction at the same time.

The present invention having been accomplished to solve the above object, in a first aspect of the invention, there is provided a $NO_x$ reduction combustion method for fulfilling $NO_x$ reduction by suppressing temperature of combustion gas derived from a burner, comprising: a $NO_x$ reduction step for suppressing combustion gas temperature in such a manner that suppression of $NO_x$ generation is preferred to reduction of exhaust CO value, thereby keeping $NO_x$ value not more than a specified value; and a CO reduction step for thereafter reducing exhaust CO value resulting from the $NO_x$ reduction step to not more than a specified value.

In a second aspect of the invention, there is provided a $NO_x$ reduction combustion method for fulfilling $NO_x$ reduction by suppressing temperature of combustion gas derived from a burner, comprising: a $NO_x$ reduction step for suppressing combustion gas temperature in such a manner that suppression of $NO_x$ generation is preferred to reduction of exhaust CO value, thereby keeping $NO_x$ value not more than 10 ppm (at 0% $O_2$ in the exhaust gas, dry basis); and a CO reduction step for thereafter reducing exhaust CO value resulting from the $NO_x$ reduction step to not more than a specified value.

In a third aspect of the invention, there is provided a $NO_x$ reduction combustion method for fulfilling $NO_x$ reduction by suppressing temperature of combustion gas derived from a burner, comprising: a $NO_x$ reduction step for suppressing combustion gas temperature in such a manner that suppression of $NO_x$ generation is preferred to reduction of exhaust CO value, thereby keeping $NO_x$ value not more than a specified value; and a CO reduction step for thereafter reducing exhaust CO value resulting from the $NO_x$ reduction step to not more than a specified value, the CO reduction step being performed in a zone where the combustion gas temperature is not more than 900° C.

In one embodiment, there is provided a $NO_x$ reduction combustion method as described in any one of the first to third aspects, wherein the $NO_x$ reduction step is performed with an excess air ratio which is determined from a $NO_x$ reduction target value and an excess air ratio versus $NO_x$ characteristic of the $NO_x$ reduction step.

In one embodiment, there is provided a $NO_x$ reduction combustion method as described in any one of the first to third aspects, wherein the CO reduction step is performed with a CO oxidation catalyst member.

In a fourth aspect of the invention, there is provided a $NO_x$ reduction combustion apparatus for fulfilling $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than a specified value; and CO reduction means for reducing exhaust CO value resulting from the $NO_x$ reduction means to not more than a specified value.

In a fifth aspect of the invention, there is provided a $NO_x$ reduction combustion apparatus for fulfilling $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than 10 ppm (at 0% $O_2$ in the exhaust gas, dry basis); and CO reduction means for reducing exhaust CO value resulting from the $NO_x$ reduction means to not more than a specified value.

In a sixth aspect of the invention, there is provided a $NO_x$ reduction combustion apparatus for fulfilling $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than a specified value; and CO reduction means for reducing exhaust CO value resulting from the $NO_x$ reduction means to not more than a specified value in a zone where the combustion gas temperature is not more than 900° C.

In one embodiment, there is provided a $NO_x$ reduction combustion apparatus as described in any one of the fourth to sixth aspects, wherein the $NO_x$ reduction is performed with an excess air ratio which is determined from a $NO_x$ reduction target value and an excess air ratio versus $NO_x$ characteristic ($NO_x$ emission characteristic) of the $NO_x$ reduction means.

In one embodiment, there is provided a $NO_x$ reduction combustion apparatus as described in any one of the fourth to sixth aspects, wherein the CO reduction means is a CO oxidation catalyst member.

In one embodiment, there is provided a $NO_x$ reduction combustion apparatus as described in any one of the fourth to sixth aspects, wherein the $NO_x$ reduction means is implemented by heat transfer tubes having a space formed by removing heat transfer tubes.

Furthermore, in one embodiment, there is provided a $NO_x$ reduction combustion apparatus as described in any one of the fourth to sixth aspects, wherein the $NO_x$ reduction means is implemented by heat transfer tubes having no space formed by removing heat transfer tubes.

Further, aspects of the present invention will be described according to the embodiments. Before the description of embodiments, terms used herein and the drawings are explained. The combustion gas includes burning-reaction ongoing (under-combustion-process) combustion gas, and combustion gas that has completed burning reaction. Then, the burning-reaction ongoing gas refers to combustion gas that is under burning reaction, and the burning-completed gas refers to combustion gas that has completed burning reaction. The burning-reaction ongoing gas is indeed a concept of substance, but can also be referred to as flame as a concept of state because it generally includes a visible flame so as to be in a flame state. Therefore, herein, the burning-reaction ongoing gas is referred to also as flame or burning flame from time to time. Further, the exhaust gas (flue gas) refers to burning-completed gas that has decreased in temperature under an effect of endothermic action by heat transfer tubes or the like.

Also, the combustion gas temperature, unless otherwise specified, means the temperature of burning-reaction ongoing gas, equivalent to combustion temperature or combustion flame temperature. Further, the suppression of combustion gas temperature refers to suppressing the maximum value of combustion gas (combustion flame) temperature to a low one. In addition, normally, burning reaction is continuing although in a trace amount even in the burning-completed gas, and so the combustion completion does not mean a 100% completion of burning reaction.

Further, the excess air ratio, which is the actual amount of combustion air/theoretical amount of combustion air, corresponds in a specified relationship to exhaust-gas $O_2$(%) (oxygen concentration in exhaust gas), therefore being expressed in exhaust-gas $O_2$(%). Also, the value of $NO_x$ shows a value at 0% $O_2$ in the exhaust gas, dry basis, while the value of CO shows not an equivalent value but a reading value.

Next, as a detailed description of the foregoing characteristics of the present invention, embodiments of the present invention are described. The present invention is applied to thermal equipment (or combustion equipment) such as small-size once-through boilers or other water-tube boilers, water heaters, reheaters of absorption refrigerators or the like. The thermal equipment has a burner and a group of heat absorbers to be heated by combustion gas derived from the burner.

An embodiment of the method according to the present invention is a $NO_x$ reduction combustion method for fulfilling $NO_x$ reduction by suppressing temperature of combustion gas jetted out from a burner, comprising: a $NO_x$ reduction step for suppressing combustion gas temperature in such a manner that suppression of $NO_x$ generation is preferred to reduction of exhaust CO value, thereby keeping the value of generated $NO_x$ not more than a specified value; and a CO reduction step for thereafter reducing exhaust CO value resulting from the $NO_x$ reduction step to not more than a specified value. This $NO_x$ reduction and CO reduction combustion method has been achieved by focusing on the characteristic that $NO_x$, once generated, will hardly disappear while CO can be easily reduced after its generation, the method being a novel, useful combustion method and $NO_x$-reduction and CO-reduction method in which the $NO_x$ reduction step is first preferentially performed so that the generated $NO_x$ value becomes a reduction target $NO_x$ value, and subsequently, the CO reduction step is performed.

First, in the $NO_x$ reduction step, the combustion gas temperature is suppressed by the $NO_x$ reduction means, so that the generated $NO_x$ value is reduced to not more than a specified value. The specified value is not more than a $NO_x$ value that has been achieved so far, and preferably not more than 10 ppm. In this $NO_x$ reduction step, $NO_x$ reduction is carried on in preference to the reduction of exhaust CO value, i.e., suppression of CO generation and acceleration of CO oxidation. This preference refers to the suppression of combustion gas temperature as much as possible under the condition of continuity of combustion, that is, the first execution of $NO_x$ reduction prior to CO reduction, and then the execution of the CO reduction subsequent to the $NO_x$ reduction, and also refers to the carrying-on of $NO_x$ reduction with CO reduction sacrificed or neglected out of $NO_x$ reduction and CO reduction, which are contradictory technical issues.

This $NO_x$ reduction step is explained in more detail. The $NO_x$ reduction step has an excess air ratio versus $NO_x$ characteristic that the generated $NO_x$ value decreases with increasing excess air ratio of the burner, as well as an excess air ratio versus CO characteristic that the exhaust CO value increases with increasing excess air ratio. In the $NO_x$ reduction step, an excess air ratio that causes the $NO_x$ value to become not more than a $NO_x$ reduction target value is determined under the condition of the excess air ratio versus $NO_x$ characteristic of this step, and the burner is burned at the resulting excess air ratio to do the $NO_x$ reduction. For the determination of this excess air ratio, the excess air ratio versus CO characteristic of the $NO_x$ reduction step is not taken into consideration.

Subsequently, in the CO reduction step, the value of CO generated and exhausted in the $NO_x$ reduction step is reduced to not more than a specified value by the CO reduction means. The specified value for this exhaust CO is 50 ppm, preferably, 20 to 30 ppm.

In this way, both a $NO_x$ reduction for the exhaust $NO_x$ value of not more than 10 ppm and a CO reduction for the exhaust CO value of not more than 50 ppm can be fulfilled.

Next, the $NO_x$ reduction step and the CO reduction step are described in terms of constitution.

The $NO_x$ reduction step includes various modes. A preferable mode thereof is that the step is carried out by $NO_x$ reduction means which comprises in combination: a combustion-gas-temperature suppression means for doing the suppression by burning a fully-premixing type gas burner at a high excess air ratio (hereinafter, referred to as "first suppression means"); a combustion-gas-temperature suppression means for doing the suppression by heat absorbers (hereinafter, referred to as "second suppression means"); a combustion-gas-temperature suppression means for doing the suppression by recirculating burning-completed gas to a burning reaction zone (hereinafter, referred to as "third suppression means"); and a combustion-gas-temperature suppression means for doing the suppression by addition of water or addition of steam (hereinafter, referred to as "water/steam addition") to the burning reaction zone (hereinafter, referred to as "fourth suppression means"). The burning reaction zone refers to a zone where burning-reaction ongoing gas is present.

The first suppression means is based on the following principle. That is, when the burner is burned at a high excess air ratio, the combustion gas temperature is suppressed so that the $NO_x$ value decreases. The high excess air ratio in this case is 5% $O_2$ or more contained in exhaust gas, preferably, not less than 5.5% $O_2$. This suppression effect acts generally uniformly on the entire burning reaction zone formed by the burner.

The second suppression means is based on the following principle. That is, the $NO_x$ value is reduced by suppressing the combustion gas temperature by a cooling effect of heat absorbers implemented by arranging a multiplicity of heat absorbers in the burning-reaction ongoing gas derived from the burner, i.e., in the burning reaction zone. This second suppression means is implemented by arranging the heat absorbers to cool the burning-reaction ongoing gas, hence a nonuniform cooling. There are also sites where the burning is ongoing actively in the gaps between the heat absorbers of the burning reaction zone. Particularly in the downstream of the heat absorbers, eddy currents are formed so that the combustion flame is stabilized by the heat transfer tubes. The heat absorbers are implemented by heat transfer tubes such as water tubes, but this is not limitative.

The arrangement configuration as to how the heat absorbers are arranged with respect to the flow of the burning-reaction ongoing gas, includes the following two modes. One of those arrangement configurations is that a combustion gas passage is formed so as to allow combustion gas to flow generally linearly therethrough from the burner to the exhaust gas outlet, and moreover the heat absorbers are arranged so as to cross the burning-reaction ongoing gas derived from the burner with gaps present among the heat absorbers to allow the combustion gas to flow therethrough. The other arrangement configuration is that heat absorbers are arrayed in an annular state with gaps present thereamong to allow the combustion gas to flow therethrough, so that the combustion gas derived from the burner flows radially from the inside of the annular heat absorbers toward the heat absorbers, where the heat absorbers are arranged in the burning-reaction ongoing gas derived from the burner. The latter configuration is described in detail in U.S. Pat. No. 6,029,614, the disclosure of which is hereby incorporated by reference.

The third suppression means is what is called exhaust-gas recirculation combustion method. Exhaust gas which has decreased in temperature through endothermic action by the heat absorbers and is then to be emitted to the atmosphere is partly mixed with combustion-use air via an exhaust-gas recirculation passage. The combustion gas temperature is suppressed by a cooling effect of the mixed exhaust gas, by which $NO_x$ value is reduced. This third suppression means exerts uniform cooling of combustion gas.

The fourth suppression means is water/steam addition to the burning reaction zone. By this water/steam addition, the burning-reaction ongoing gas is cooled, so that the combustion gas temperature is suppressed and the $NO_x$ value is reduced. This fourth suppression means also exerts uniform cooling of the combustion gas. The water/steam addition may be carried out in the exhaust-gas recirculation passage in another embodiment. Besides, in an embodiment in which the burner is provided as a fully-premixing type gas burner and mixed gas of combustion-use air and fuel gas is fed to the burner by a blower, it is possible to perform the steam addition between the burner and the blower. For the water addition, water is added in the form of mist.

Working effects by the combination of the first to fourth suppression means are as follows. Enhancing the functions of the individual suppression means singly would cause drawbacks of the respective suppression means to matter. However, combining the four suppression means makes it possible to achieve super $NO_x$ reduction relatively easily without causing the emergence of those drawbacks. In particular, later-described unstable characteristics of the fourth suppression means are alleviated, so that stable $NO_x$ reduction can be achieved.

It is noted that the functional enhancement of the first suppression means (premixing high excess-air-ratio combustion) is to increase the excess air ratio. Due to this functional enhancement, there would occur a halt of burning reaction and an unstable combustion of the combustion burner. Also, the functional enhancement of the second suppression means (heat-absorber cooling) is the provision of the heat transfer tubes in contact with the burner or the increasing of the heat-transfer-surface density of the heat absorbers. Due to this functional enhancement, there would occur an increase in pressure loss or an unstable combustion such as oscillating combustion.

Also, the functional enhancement of the third suppression means (exhaust gas recirculation) is to increase the exhaust-gas recirculation quantity. Due to this functional enhancement, there would occur an amplification of the unstable characteristics of the third suppression means. That is, the exhaust gas recirculation has a characteristic that the exhaust-gas flow rate or temperature changes with changes in combustion quantity or changes in load. An increase in the exhaust-gas recirculation quantity would cause these unstable characteristics to be amplified, making it impossible to achieve a stable $NO_x$ reduction. Also, due to the functional enhancement of the third suppression means, burning reaction would be suppressed, causing an emission increase of CO and unburned components as well as an increase in thermal loss. Further, increasing the exhaust-gas recirculation quantity would cause the blower load to increase.

Also, the functional enhancement of the fourth suppression means (water/steam addition) is to increase the quantity of water to be added. Due to this functional enhancement, the quantity of condensations would increase with increasing thermal loss, where, particularly in boilers having a feed water preheater for preheating the water fed to the heat absorbers by exhaust gas, there would matter corrosion due to the condensations of the feed water preheater.

According to the embodiment, since the first to fourth suppression means are combined together, the problems that would otherwise emerge upon enhancing the functions of the individual suppression means each singly can be prevented from becoming issues.

Furthermore, in the foregoing embodiment, preferably, an excess-air-ratio control means for controlling the excess air ratio to a specified high excess air ratio is additionally provided. More specifically, an oxygen concentration detection means for detecting the oxygen concentration in exhaust gas is provided, and the rotational speed of the blower for blowing combustion-use air to the burner is controlled so that the oxygen concentration detected by the oxygen concentration detection means becomes a set value corresponding to the specified high excess air ratio. The specified high excess air ratio is determined in the following manner. Given a $NO_x$ reduction target value of 10 ppm, an excess air ratio corresponding to the target value is determined under the condition of the excess air ratio versus $NO_x$ characteristic of the $NO_x$ reduction step, and then the excess air ratio determined in this way or a value higher than the excess air ratio is taken as a specified high excess air ratio. Finally, the specified high excess air ratio corresponds to the $NO_x$ reduction target value.

In this connection, the foregoing embodiment includes the following modifications. First, the $NO_x$ reduction means for fulfilling the $NO_x$ reduction step includes the following five modifications: (1) a mode in which three suppression means of the second suppression means (heat-absorber cooling), the third suppression means (exhaust gas recirculation) and the fourth suppression means (water/steam addition) are combined together excluding the first suppression means (premixing high excess-air-ratio combustion); (2) a mode in which three suppression means of the first suppression means (premixing high excess-air-ratio combustion), the second suppression means (heat-absorber cooling) and the third suppression means (exhaust gas recirculation) are combined together; (3) a mode in which three suppression means of the first suppression means (premixing high excess-air-ratio combustion), the second suppression means (heat-absorber cooling) and the fourth suppression means (water/steam addition) are combined together; (4) a mode in which two suppression means of the second suppression means (heat-absorber cooling) and the third suppression means (exhaust gas recirculation) are combined together; and (5) a mode in which two suppression means of the second suppression means (heat-absorber cooling) and the fourth suppression means (water/steam addition) are combined together.

Although all of these modifications include the second suppression means (heat-absorber cooling), yet this is not limitative. The reason of this is that the present invention, which includes first performing $NO_x$ reduction in preference to CO reduction and thereafter performing CO reduction, has no limitation for any particular $NO_x$ reduction means, even though some $NO_x$ reduction means are preferable. The $NO_x$ reduction means in this embodiment is designed for those in which carrying on $NO_x$ reduction forward to achieve a $NO_x$ reduction target would cause the exhaust CO value to exceed a CO reduction target value. Further, the type and form of the burner to be used for the $NO_x$ reduction means is not limited to particular ones, either.

The excess-air-ratio control means includes the following modifications. The foregoing excess-air-ratio control means is designed to control the rotational speed of the blower. Instead, the excess-air-ratio control means may be designed to control the opening of a combustion-use-air flow rate adjusting means such as a damper or a valve provided downstream or upstream of the blower so that the excess air ratio is controlled constant. Further, in another embodiment, it is also possible that an outside-air temperature detection means for detecting outside-air temperature is provided in place of the oxygen concentration detection means, where the blower or the flow rate adjusting means is controlled by this outside-air temperature detection means so that the excess air ratio is controlled constant.

Next, the constitution of the CO reduction step is explained. This CO reduction step is a step in which the value of CO generated and emitted from the foregoing $NO_x$ reduction step is reduced to not more than a specified value by the CO reduction means.

The CO reduction step is carried out, preferably, in a zone where the temperature of combustion gas is not more than 900° C. It is known that CO, if allowed to stand for a necessary residence time with the combustion gas temperature in a range of 900° C. to 1400° C., oxidizes into $CO_2$. Unfortunately, an attempt to maintain this temperature would be a constraint on the preferential execution of $NO_x$ reduction. However, this constraint can be eliminated by performing the CO reduction in a zone where the combustion gas temperature is not more than 900° C. By performing the selection of the CO reduction means, conditions as to thermal resistance are relaxed, so that an easier selection is allowed.

As the CO reduction means, CO oxidation means for oxidizing CO into $CO_2$ is used, preferably, a CO oxidation catalyst is used. This CO oxidation catalyst serves not only for the oxidation of CO but also oxidation of unburned components. The CO oxidation catalyst is a preferable means in terms of its fittability to boilers or other thermal equipment, maintenance performance and cost.

As the CO oxidation catalyst, one which exerts oxidation catalysis at 100° C. to 1000° C. is selected. The lower-limit 100° C. is an activation temperature of the CO oxidation catalyst, i.e., a temperature at which it exerts an effective oxidation catalysis, while the upper-limit 1000° C. is a temperature determined in another embodiment thermal resistance of the CO oxidation catalyst. In conclusion, the CO oxidation catalyst is disposed, on the passage along which the combustion gas derived from the burner is distributed, in a zone where the combustion gas temperature is not more than 900° C. in terms of the preference of $NO_x$ reduction and not less than 100° C. in terms of the activation temperature of the CO oxidation catalyst. A specific disposition place of the CO oxidation catalyst is determined in consideration of the boiler body structure of thermal equipment or other factors.

The CO oxidation catalyst is formed so that a base material having air permeability is coated with an oxidation catalyst. The base material, provided by stainless or other metal, ceramic or the like, is subjected to such surface treatment that a wider contact area with exhaust gas can be obtained. The oxidation catalyst is generally provided by platinum, but in another embodiment, may be given by platinum group noble metals, or metal oxides of chromium, manganese, iron, cobalt, nickel or the like.

Next, embodiments of the combustion apparatus for $NO_x$ reduction of the present invention are described. The present invention includes the following embodiments of the apparatus corresponding to the foregoing embodiments of the method (1) to (6).

Embodiment (1): A combustion apparatus for $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than a specified value; and CO reduction means for reducing exhaust CO value resulting from the $NO_x$ reduction means to not more than a specified value.

Embodiment (2): A combustion apparatus for $NO_x$ reduction by suppressing temperature of combustion gas derived from a burner, comprising: $NO_x$ reduction means for suppressing combustion gas temperature so that $NO_x$ value in burning-completed gas is reduced to not more than 10 ppm; and CO reduction means for reducing exhaust CO value resulting from the $NO_x$ reduction means to not more than a specified value.

Embodiment (3): A combustion apparatus for $NO_x$ reduction, comprising: $NO_x$ reduction means for fulfilling $NO_x$ reduction by a combination of a means for suppressing combustion gas temperature by burning a fully-premixing type burner at a high excess air ratio, a means for suppressing combustion gas temperature by heat absorbers, a means for suppressing combustion gas temperature by recirculating burning-completed gas to a burning reaction zone of combustion gas, and a means for suppressing combustion gas temperature by adding water or steam to the burning reaction zone; and CO reduction means for oxidizing exhaust CO from the $NO_x$ reduction means so that the CO value is reduced to not more than a specified value.

Embodiment (4): A combustion apparatus for $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than a specified value; and CO reduction means for reducing exhaust CO value resulting from the $NO_x$ reduction means to not more than a specified value in a zone where the combustion gas temperature is not more than 900° C.

Embodiment (5): A combustion apparatus for $NO_x$ reduction by suppressing temperature of combustion gas derived from a burner, comprising: $NO_x$ reduction means having an excess air ratio versus $NO_x$ characteristic that generated $NO_x$ value decreases with increasing excess air ratio of the burner, as well as an excess air ratio versus CO characteristic that exhaust CO value increases with increasing excess air ratio; and CO reduction means for reducing exhaust CO value resulting from the $NO_x$ reduction means to not more than a specified value, wherein the $NO_x$ reduction is performed by burning the burner at an excess air ratio which is determined from $NO_x$ reduction target value and the excess air ratio versus $NO_x$ characteristic.

Embodiment (6): A combustion apparatus for $NO_x$ reduction as defined in any one of the foregoing embodiments (1) to (5), wherein the CO reduction means is a CO oxidation catalyst member.

Furthermore, the embodiments of the apparatus further include the following embodiments (7) to (9).

Embodiment (7): A combustion apparatus for $NO_x$ reduction by controlling temperature of combustion gas derived from a burner, comprising: $NO_x$ reduction means having an excess air ratio versus $NO_x$ characteristic that generated $NO_x$ value decreases with increasing excess air ratio of the burner, as well as an excess air ratio versus CO characteristic that exhaust CO value increases with increasing excess air ratio; excess-air-ratio control means for controlling excess air ratio of the burner to a specified high excess air ratio; and CO reduction means for reducing exhaust CO value resulting from the $NO_x$ reduction means to not more than a specified value.

Embodiment (8): A combustion apparatus for $NO_x$ reduction as defined in the foregoing embodiment (7), wherein the specified excess air ratio is determined from a $NO_x$ reduction target value and the excess air ratio versus $NO_x$ characteristic.

Embodiment (9): A combustion apparatus for $NO_x$ reduction and CO reduction as defined in any one of the foregoing embodiments (7) to (8), wherein the CO reduction means is a CO oxidation catalyst member.

In the foregoing embodiment (3), the $NO_x$ reduction means is implemented by a combination of the first suppression means to fourth suppression means. However, in another embodiment, the $NO_x$ reduction means may also be implemented according to the five modifications described in the embodiments of the method other than this combination. In the Embodiment (7), the excess-air-ratio control means is similar to that described in the embodiments of the method.

The embodiments (1) to (9) are capable of achieving both $NO_x$ reduction and CO reduction at the same time, and the embodiments (7) to (8) are capable of achieving a stable $NO_x$ reduction by constant excess-air-ratio control even with outside air temperature varied.

Also, in the foregoing embodiments, the $NO_x$ reduction step may include CO reduction by CO reduction means, and the $NO_x$ reduction means may include CO reduction means. This CO reduction means is a heat-absorber removal space for CO oxidation (i.e., CO oxidation space) formed by eliminating some of the heat absorbers. As stated before, CO, if allowed to stand for a necessary residence time with the combustion gas temperature in a range of 900° C. to 1400° C., oxidizes into $CO_2$. The aforementioned space, to which this principle is applied, is a space formed by removing plural ones among the heat absorbers and having such a constitution that the combustion gas temperature falls within the aforementioned temperature range under the continued-combustion condition.

DETAILED DESCRIPTION OF THE PREFERRED EMBODIMENTS

Figure 1:
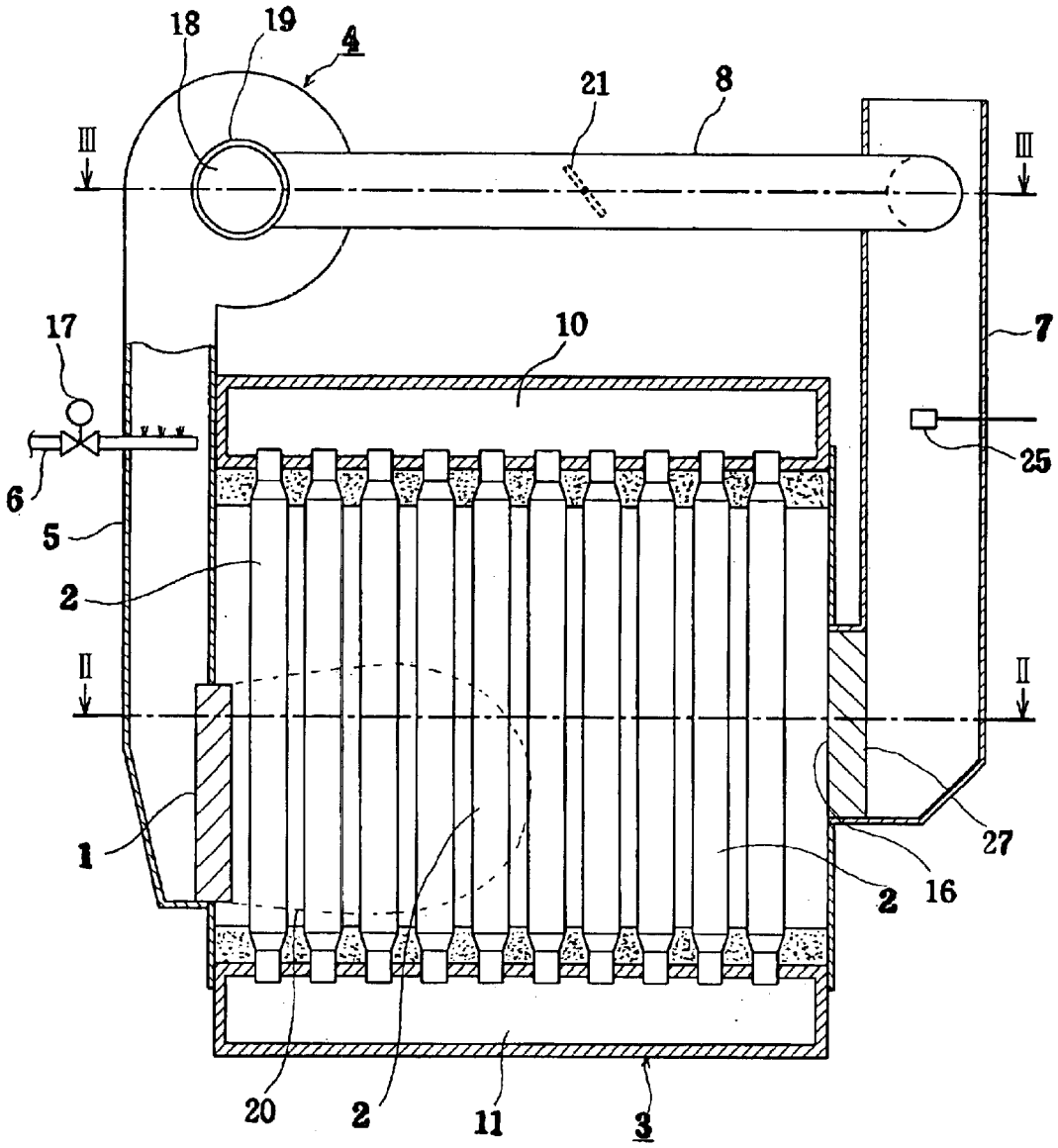
FIG. 1 is an explanatory view of a longitudinal section of a steam boiler to which an embodiment of the present invention is applied.
Figure 2:
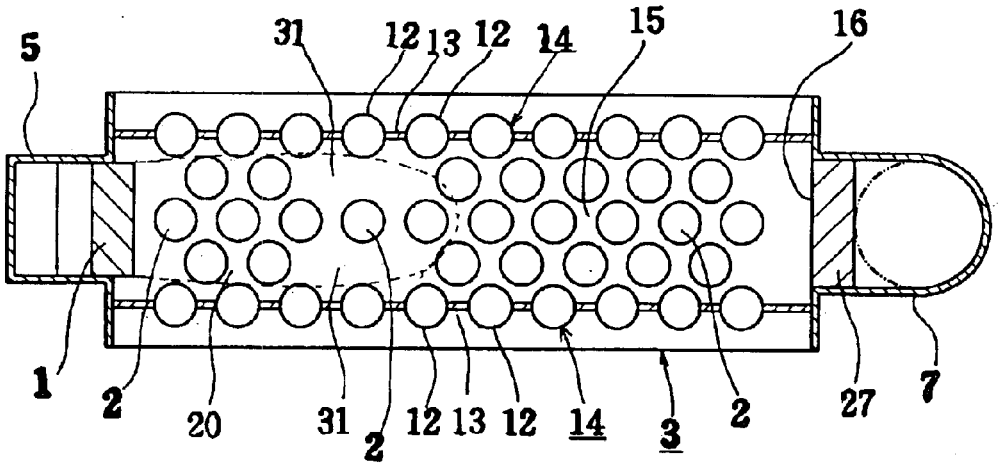
FIG. 2 is a sectional explanatory view of the same embodiment taken along the line II—II of FIG. 1.
Figure 3:
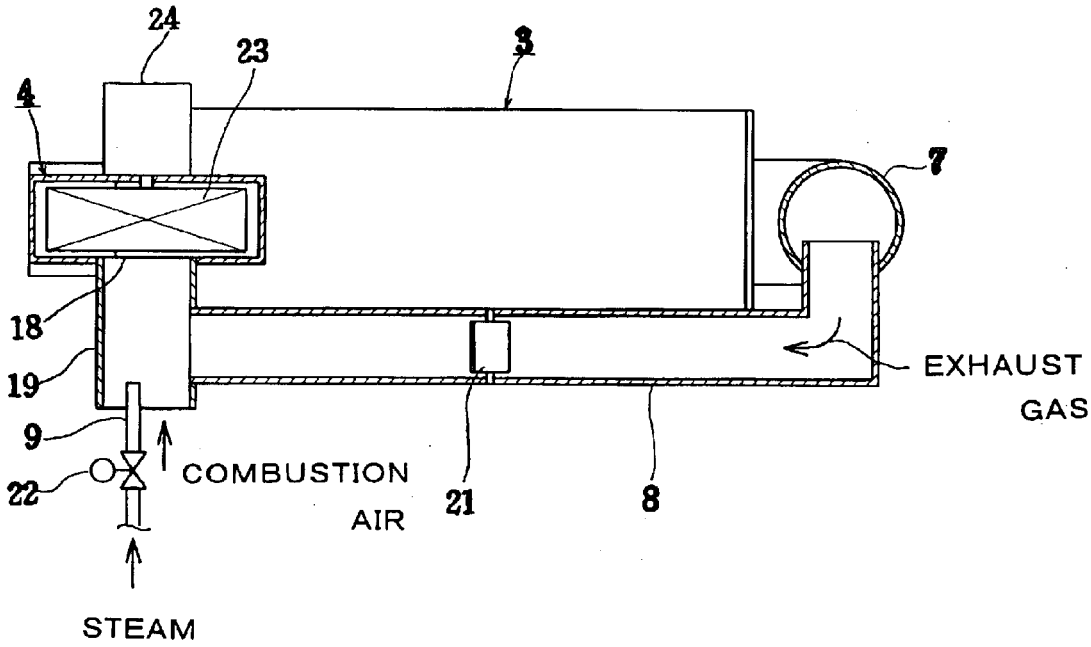
FIG. 3 is a cross-sectional explanatory view of the same embodiment taken along the line III—III of FIG. 1.
Figure 4:
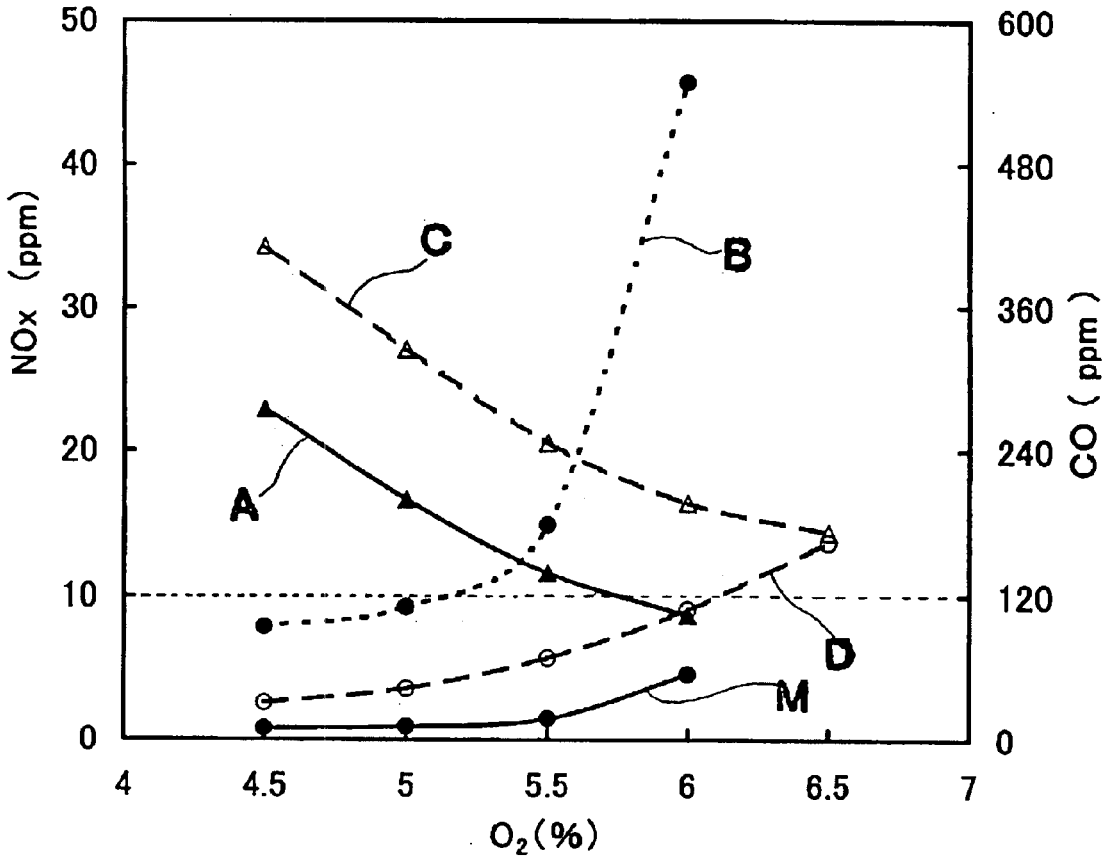
FIG. 4 is a chart showing excess air ratio versus $NO_x$ characteristic ($NO_x$ emission characteristic) curves, and excess air ratio versus CO characteristic (CO emission characteristic) curves in high combustion state of the steam boiler of the same embodiment shown in FIG. 1.
Figure 5:
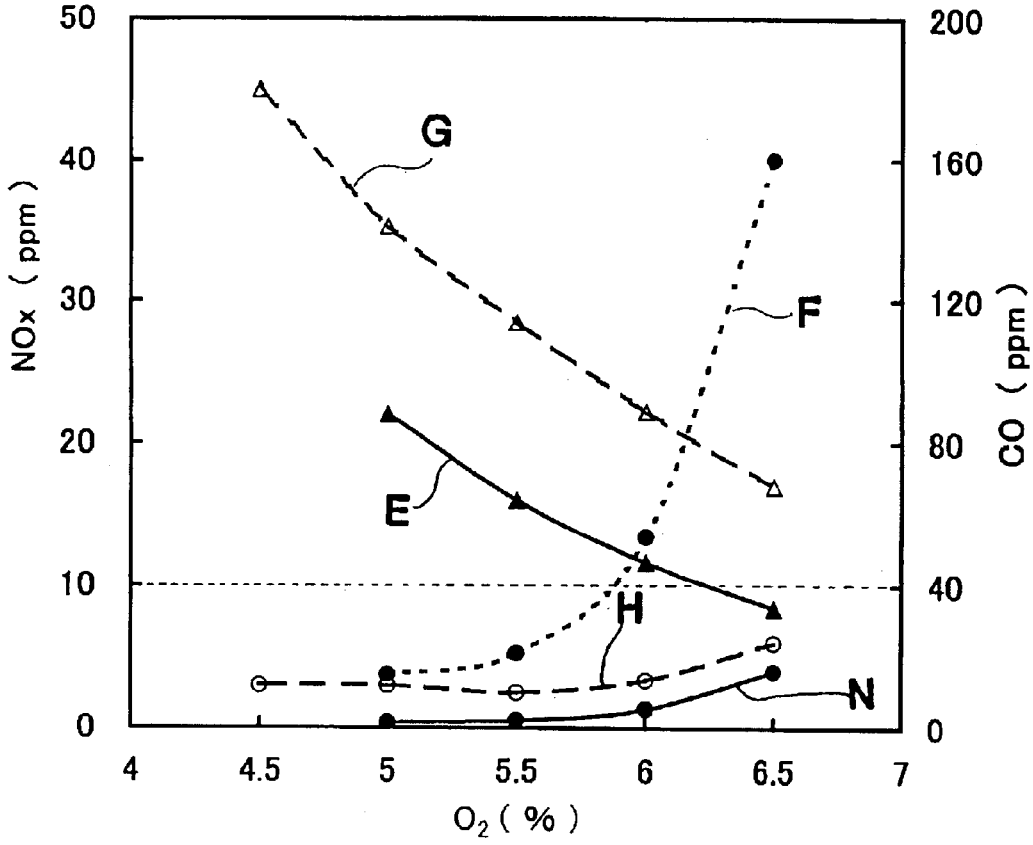
FIG. 5 is a chart showing excess air ratio versus $NO_x$ characteristic curves, and excess air ratio versus CO characteristic curves in low combustion state of the steam boiler of the same embodiment shown in FIG. 1.
Figure 6:
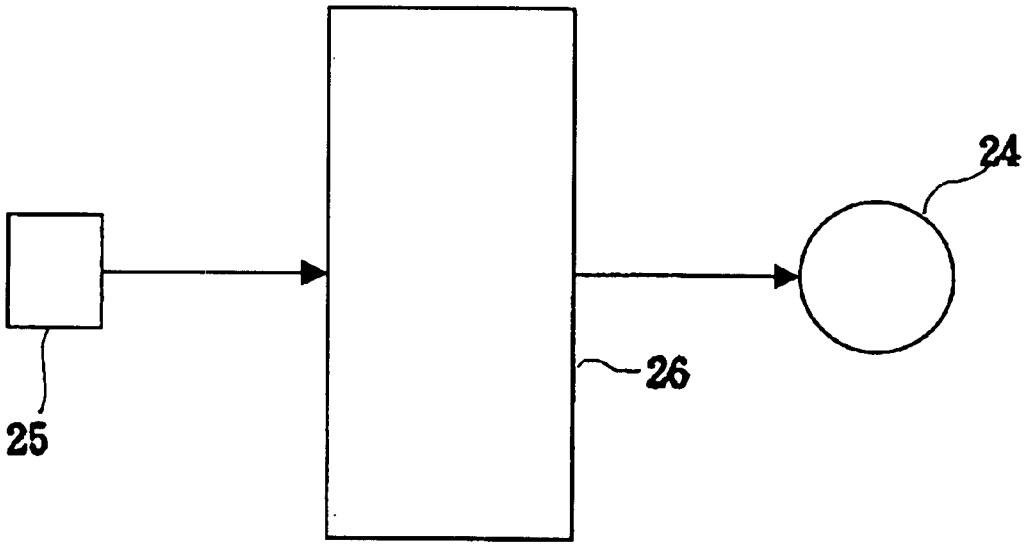
FIG. 6 is a main-part control circuit diagram of the steam boiler of the same embodiment shown in FIG. 1.
Figure 7:
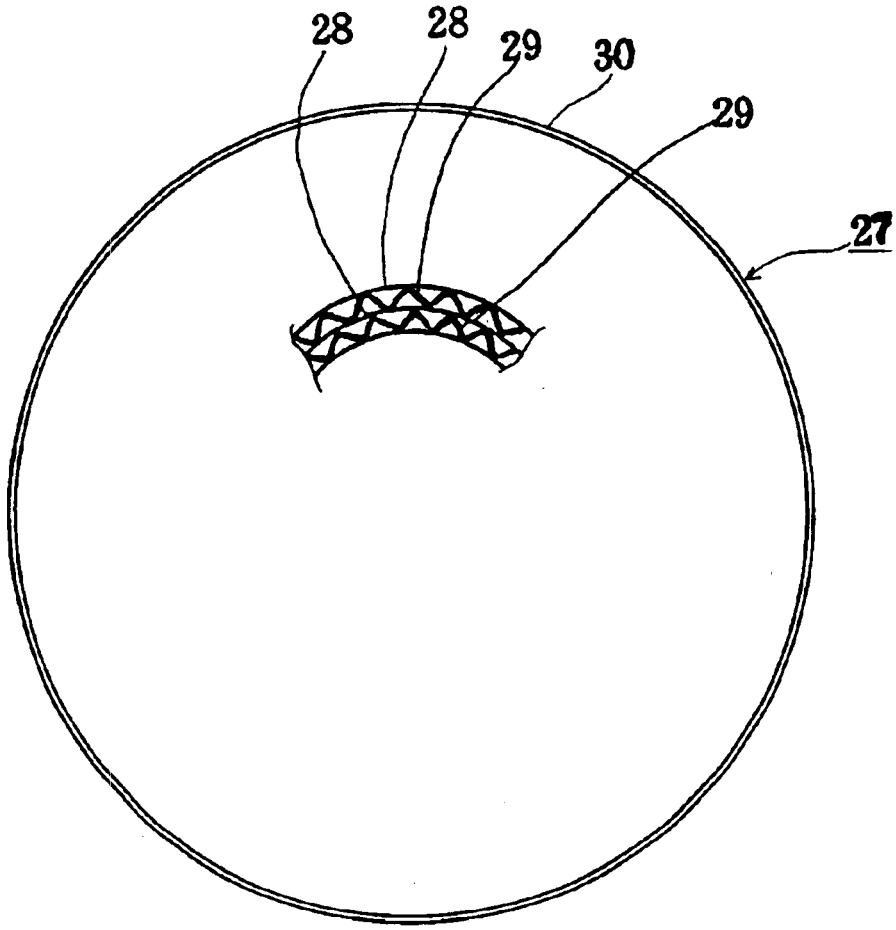
FIG. 7 is a front view showing a main-part constitution of a CO oxidation catalyst member in the steam boiler of the same embodiment shown in FIG. 1.

Hereinbelow, working examples in which the $NO_x$ reduction combustion method and apparatus of the present invention are applied to a once-through steam boiler, which is one type of water-tube boilers, are described in accordance with the accompanying drawings. FIG. 1 is an explanatory view of a longitudinal section of a steam boiler to which an embodiment of the present invention is applied, FIG. 2 is a sectional view taken along the line II—II of FIG. 1, FIG. 3 is a cross-sectional view taken along the line III—III of FIG. 1, FIGS. 4 and 5 are charts showing excess air ratio versus $NO_x$ characteristic curves as well as excess air ratio versus CO characteristic curves in high combustion state and low combustion state, respectively, in the embodiment shown in FIG. 1, FIG. 6 is a main-part control circuit diagram of embodiment shown in FIG. 1, and FIG. 7 is a view showing a main-part constitution of a CO oxidation catalyst member in the embodiment shown in FIG. 1, as viewed along the direction of the exhaust gas flow.

Now the overall construction of the boiler according to this embodiment is explained below, and then the construction of its characteristic parts is explained. The characteristic parts include: $NO_x$ reduction means for performing $NO_x$ reduction in combination of a combustion-gas-temperature suppression means for doing the suppression by burning a fully-premixing type gas burner at a high excess air ratio (first suppression means), a combustion-gas-temperature suppression means for doing the suppression by a multiplicity of heat transfer tubes (second suppression means), a combustion-gas-temperature suppression means for doing the suppression by recirculating burning-completed gas to a burning reaction zone (third suppression means), and a combustion-gas-temperature suppression means for doing the suppression by addition of steam to the burning reaction zone (fourth suppression means); an excess-air-ratio control means for controlling the excess air ratio of the burner to maintain it at a specified high excess air ratio; and a CO reduction means for reducing the exhaust CO value to a specified value or lower by oxidizing CO emitted from the $NO_x$ reduction means.

First, the overall construction of the steam boiler is explained. This steam boiler is switchable between operations at high combustion and low combustion. Then, the steam boiler comprises: a boiler body 3 having a fully-premixing type burner 1 having a planar burning surface (jet-out surface for premixed gas and a multiplicity of endothermic-use heat transfer tubes 2, 2, . . . , a blower 4 and an air supply passage 5 for feeding combustion-use air to the burner 1; a gas fuel supply tube 6; an exhaust gas passage (normally referred to as 'flue') 7 for discharging exhaust gas exhausted from the boiler body 3; an exhaust-gas recirculation passage 8 for mixing, into the combustion-use air, part of the exhaust gas that is circulating along the exhaust gas passage 7 to feed it to the burner 1; and a steam addition tube 9 (see FIG. 3) for adding steam to the combustion-use air. It is noted that the outer diameter of each of the heat transfer tubes 2 is 60.5 mm.

The boiler body 3 is provided with an upper header 10 and a lower header 11, and has a plurality of the heat transfer tubes 2 arranged between the two headers 10, 11. Referring to FIG. 2, a pair of water walls 14, 14 formed by coupling outer heat transfer tubes 12, 12, . . . to one another with coupling members 13, 13, . . . are provided on lengthwise both sides of the boiler body 3, so that a combustion gas passage 15 that allows burning-reaction ongoing gas and burning-completed gas derived from the burner 1 to pass generally linearly therethrough is formed between the two water walls 14, 14 and the upper header 10 and the lower header 11.

Next, conjunction relationships among the foregoing individual elements are explained. As shown in FIG. 1, the burner 1 is provided at one end of the combustion gas passage 15, and the exhaust gas passage 7 is connected to an exhaust gas outlet 16 located at the other end. The air supply passage 5 is connected to the burner 1, and the gas fuel supply tube 6 is connected to the air supply passage 5 so that fuel gas is jetted out into the air supply passage 5. The gas fuel supply tube 6 is provided with a first valve 17 as a fuel flow adjusting means for adjusting the fuel flow between high combustion and low combustion. On the air supply passage 5 is provided a throttle portion (not shown), which is so called venturi, for enhancing the mixability of the fuel gas and the combustion-use air, but the throttle portion may be omitted for reduction of pressure loss according to the embodiment.

Further, as shown in FIG. 3, an air inlet passage 19 is connected to an inlet port 18 of the blower 4, and the exhaust-gas recirculation passage 8 is connected between the air inlet passage 19 and the exhaust gas passage 7. The steam addition tube 9 is inserted in the air inlet passage 19.

Operation of this steam boiler based on the above-described constitution is outlined below. In the air supply passage 5, combustion-use air (outside air) fed through the air inlet passage 19 is premixed with fuel gas fed through the gas fuel supply tube 6, and the resulting premixed gas is jetted out from the burner 1 into the boiler body 3. The premixed gas is ignited by an ignition means (not shown), thus burning. Burning-reaction ongoing gas generated along with this burning crosses with upstream-side heat transfer tubes 2 so as to be cooled, resulting in burning-completed gas, which exchanges heat with downstream-side heat transfer tubes 2 so that its heat is absorbed, thus resulting in exhaust gas. The resultant exhaust gas is discharged into the atmosphere through the exhaust gas passage 7. Then, part of the exhaust gas is fed to the burner 1 through the exhaust-gas recirculation passage 8, and used for suppression of combustion gas temperature.

Water in the individual heat transfer tubes 2 is heated by the heat exchange with the combustion gas, thereby changed into steam. This steam is fed from a steam extraction means (not shown), which is connected to the upper header 10, to steam-utilizing equipment (not shown), while part of the steam is fed to the steam addition tube 9 so as to be used for the cooling of the burning-reaction ongoing gas.

Next, the above-noted characteristic parts of this embodiment are explained. First, the first suppression means of the $NO_x$ reduction means is explained. This first suppression means is so structured that the fully-premixing type burner 1 burns at a high excess air ratio. When the burner 1 is put into burning at a high excess air ratio, the combustion gas temperature is suppressed, so that the value of $NO_x$ is lowered. The burner 1 is a longitudinally 60 cm, laterally 18 cm sized rectangular-shaped burner, having a multiplicity of premixed-gas nozzles (not shown) formed generally evenly therein.

The second suppression means is so constructed that a multiplicity of the heat transfer tubes 2 are arranged generally all over the burning reaction zone (a zone where the combustion gas temperature is not less than about 900° C.) 20 formed by the burner 1, with gaps present thereamong to allow the combustion gas to flow therethrough. The burning-reaction ongoing gas derived from the burner 1 is cooled by these heat transfer tubes 2. As a result of this cooling, the combustion gas temperature is suppressed, so that the value of $NO_x$ is lowered. The arrangement pitch of the heat transfer tubes 2, which affects the degree of cooling of the combustion gas, is determined in consideration of the amount of combustion per time, pressure loss and the like.

The third suppression means is an exhaust-gas recirculating means composed of the exhaust gas passage 7, the exhaust-gas recirculation passage 8, the air supply passage 5 and the burner 1. At a proper place within the exhaust-gas recirculation passage 8 is provided a first damper 21 as a gas flow rate adjusting means for adjusting the quantity of exhaust gas to be recirculated (exhaust-gas recirculation quantity) to a specified quantity. Mixing exhaust gas with the premixed gas fed to the burner 1 causes the combustion gas temperature to be suppressed, so that the value of $NO_x$ lowers. The ratio of exhaust-gas recirculation quantity to combustion-use air quantity (actual combustion air quantity) is adjusted by the first damper 21.

The fourth suppression means, as shown in FIG. 3, is composed of the steam addition tube 9, the air inlet passage 19, the blower 4, the air supply passage 5 and the burner 1. An upstream end of the steam addition tube 9 is connected to the upper header 10 via a second valve 22 serving as a steam flow rate adjusting means for adjusting the quantity of steam addition, so that steam generated by the steam boiler is utilized as it is. Between the second valve 22 and the upper header 10 is provided an orifice or other pressure reducing mechanism (not shown). The steam is mixed uniformly into the combustion-use air fed to the burner 1, and jetted out into the boiler body 3 generally uniformly from a multiplicity of premixed-gas nozzles (not shown) of the burner 1. As a result, an effective cooling of the expandedly formed premixed combustion flame is achieved.

The steam boiler of this working example, as stated before, is switchable between operations at high combustion and low combustion. Then, the $NO_x$ reduction means of this steam boiler has the excess air ratio versus $NO_x$ characteristics and the excess air ratio versus CO characteristics in high combustion state and low combustion state shown in FIGS. 4 and 5. These excess air ratio versus $NO_x$ characteristics and excess air ratio versus CO characteristics are explained below.

First, the excess air ratio versus $NO_x$ characteristic and the excess air ratio versus CO characteristic in the high combustion state are determined as shown by a curve A and a curve B, respectively, of FIG. 4 with the excess air ratio varied under certain operating conditions. These operating conditions are a fuel of LPG, a combustion rate of the burner 1 of 50 $Nm^3/h$ (combustion rate of the steam boiler at high combustion), an exhaust-gas recirculation rate of 4% (exhaust-gas recirculation quantity/actual combustion air quantity), and a steam addition amount of 17 kg/h. Then, the actual combustion air quantity and the exhaust-gas recirculation quantity at the exhaust-gas recirculation rate of 4% are 1669 $Nm^3/h$ and 67 $Nm^3/h$, respectively, at 6% $O_2$, for instance.

Varying the excess air ratio is implemented by varying the actual combustion air quantity. Varying the actual combustion air quantity is implemented by controlling the rotational speed of an electric motor 24 (see FIG. 3) that drives a fan 23 of the blower 4.

The excess air ratio versus $NO_x$ characteristic in the high combustion state of the $NO_x$ reduction means is, as shown by the curve A, one that the $NO_x$ value decreases with increasing excess air ratio. Also, the excess air ratio versus CO characteristic is, as shown by the curve B, one that the exhaust CO value increases with increasing excess air ratio, in particular, the exhaust CO value abruptly increases at 5% $O_2$ or more. It is noted that a curve C and a curve D in FIG. 4 represent an excess air ratio versus $NO_x$ characteristic and an excess air ratio versus CO characteristic of comparative examples in which the suppressions of combustion gas temperature by the third suppression means and the fourth suppression means are not performed, given for contrast to the curve A and the curve B of this working example.

Next, the excess air ratio versus $NO_x$ characteristics and the excess air ratio versus CO characteristic in the low combustion state of the $NO_x$ reduction means are explained below. These characteristics are determined as shown by a curve E and a curve F, respectively, of FIG. 5 as in the case of the high combustion state. The operating conditions in the low combustion state are a fuel of LPG, a combustion rate of the burner of 25 $Nm^3/h$ (combustion rate of the steam boiler at low combustion), an exhaust-gas recirculation rate of 4% (exhaust-gas recirculation quantity/actual combustion air quantity), and a steam addition amount of 8.5 kg/h. Then, the actual combustion air quantity and the exhaust-gas recirculation quantity at the exhaust-gas recirculation rate of 4% are 834 $Nm^3/h$ and 33 $Nm^3/h$, respectively, at 6% $O_2$, for instance.

The excess air ratio versus $NO_x$ characteristic in the low combustion state of the $NO_x$ reduction means is, as shown by the curve E, also one that the $NO_x$ value decreases with increasing excess air ratio. Further, the excess air ratio versus CO characteristic is, as shown by the curve F, one that the exhaust CO value increases with increasing excess air ratio, in particular, the exhaust CO value abruptly increases at 5.5% $O_2$ or more. It is noted that a curve G and a curve H in FIG. 5 represent an excess air ratio versus $NO_x$ characteristic and an excess air ratio versus CO characteristic of comparative examples in which the suppressions of combustion gas temperature by the third suppression means and the fourth suppression means are not performed, given for contrast to the curve E and the curve F of this working example.

The excess-air-ratio control means, as shown in FIG. 6, is composed of an oxygen concentration sensor 25 provided on the exhaust gas passage 7 and serving as the oxygen concentration detection means, and a control circuit 26 to which an output of the oxygen concentration sensor 25 is inputted and which controls the rotational speed of the electric motor 24. The electric motor 24 is so designed as to be controllable in rotational speed by inverter control. By controlling the rotational speed of the fan 23 so that the excess air ratio of the burner 1 becomes a specified high excess air ratio (specified value), a specified $NO_x$ reduction effect is maintained against changes in outside air temperature.

In this working example, given a $NO_x$ reduction target value of 10 ppm, the specified value can be determined as 5.8% $O_2$ in the high combustion state from the curve A of FIG. 4 and the value of 10 ppm. Of course, an $O_2$ ratio of higher than 5.8% satisfies the reduction target value, and so the specified value may be set to, for example, 6%. For the low combustion state, the specified value can be determined as 6.25% $O_2$ from the curve E of FIG. 5 and the value of 10 ppm.

Next, the CO reduction means is explained. This CO reduction means oxidizes CO emitted from the $NO_x$ reduction means to achieve CO reduction below a CO reduction target value. The CO reduction means is disposed in the downstream of the heat transfer tubes 2.

The CO reduction means in this working example is implemented by a CO oxidation catalyst member 27 that reduces the CO value to about 1/10. CO reduction characteristic by this CO oxidation catalyst member 27 is shown by a curve M of FIG. 4 and a curve N of FIG. 5. CO quantities in the exhaust gas shown by the curve D and the curve H are finally reduced as shown by the curve M and the curve N, respectively.

This CO oxidation catalyst member 27, having such a structure shown in FIG. 7, is formed in the following manner, for example. With a flat plate 28 and a wave plate 29 as base materials, both of which are made of stainless steel, a multiplicity of minute pits and bumps are formed on their surfaces, and oxidation catalyst is applied on top of the surfaces. Then, the flat plate 28 and the wave plate 29, both of a specified width, are laid on each other and spirally rolled into a roll state. This roll is surrounded and fixed by a side plate 30. In this way, the CO oxidation catalyst member 27 as shown in FIG. 7 is formed. Platinum is used as the oxidation catalyst. It is noted that FIG. 7 shows only part of the flat plate 28 and the wave plate 29.

The CO oxidation catalyst member 27, as shown in FIG. 1, is removably fitted to the exhaust gas outlet 16 portion. Combustion gas temperature at the exhaust gas outlet 16 portion is about 250° C. to 350° C. Size and processing capacity of the CO oxidation catalyst member 27 are designed in consideration of the performance of the oxidation catalyst, the quantity of CO to be oxidized, and the pressure loss occurring when the exhaust gas flows through the CO oxidation catalyst member 27.

Further, the CO reduction means, as shown in FIG. 2, includes the CO oxidation catalyst member 27 and another CO reduction means. This CO reduction means is a heat-transfer-tube removal space 31 called heat insulating space formed in the heat transfer tubes 2. Then, as shown in FIG. 2, part of the heat transfer tubes 2 (four heat transfer tubes 2 in this working example) are removed so that the heat-transfer-tube removal space 31 where the combustion gas temperature falls within a range not more than 1400° C. and not less than 900° C. is formed.

The heat-transfer-tube removal space 31 falls generally within the aforementioned temperature range in the high combustion state, while it involves a shorter combustion flame, i.e., a narrower burning reaction zone in the low combustion state so as to no longer fall within the temperature range. Accordingly, the CO oxidation catalyst member 27 and the heat-transfer-tube removal space 31 serve as CO reduction means in the high combustion state, while the heat-transfer-tube removal space 31 does not serve as CO reduction means and the CO oxidation catalyst member 27 serves as CO reduction means in the low combustion state.

Operations and actions of the working example of the above-described constitution are explained below. Burning-reaction ongoing gas derived from the burner 1 is subjected to a $NO_x$ reduction action, i.e., combustion-gas-temperature suppression actions by the first to fourth suppression means, at the same time, and still also subjected to such constant excess-air-ratio control that $O_2$ (%) is held at 5.8 in the high combustion state and at 6.25 in the low combustion state by the excess-air-ratio control means. By the combustion-gas-temperature suppression action of this working example, the combustion gas temperature is lowered by about 100° C. on an average, compared with the comparative example in which the burning-reaction ongoing gas is not subjected to the actions by the third suppression means and the fourth suppression means. As a result, the $NO_x$ value in the combustion gas flowing out from the upstream-side heat transfer tubes 2 is suppressed to about 10 ppm as shown by the curve A and curve E of FIGS. 4 and 5, respectively.

CO generated in the $NO_x$ reduction shown above is reduced in the following manner. The generated CO is, first, partly oxidized at the heat-transfer-tube removal space 31 in the high combustion state, and scarcely oxidized in the low combustion state. Since this oxidation of CO is scarcely performed with the combustion gas temperature below 900° C., the value of CO in the exhaust gas at the exhaust gas outlet 16 is about 400 ppm in the high combustion state and about 100 ppm in the low combustion state as shown by the characteristic curve B and curve F of FIGS. 4 and 5, respectively. CO remaining in this exhaust gas is oxidized by the CO oxidation catalyst member 27 so that the CO value is reduced to about 1/10, as shown by the characteristic curve M and curve N of FIGS. 4 and 5.

According to this working example, the following working effects are produced. Since the $NO_x$ reduction is preferentially performed and thereafter the CO reduction is performed, the $NO_x$ reduction can be facilitated and the selection of $NO_x$ reduction means can be done more easily without considering the CO value. As a result, the $NO_x$ reduction for reducing the value of generated $NO_x$ to not more than 10 ppm can easily be fulfilled, and yet the CO reduction can securely be fulfilled.

Also, since the excess air ratio can be controlled to a generally constant high excess air ratio by the excess-air-ratio control means, a stable $NO_x$ reduction effect can be obtained even with outside air temperature varied. As a result, the $NO_x$ reduction target value can be met over a wide range of operating points on the day and year bases.

Further, the exhaust CO value from the $NO_x$ reduction means is also controlled to a constant one by the constant excess-air-ratio control. As a result, the possibility that the exhaust CO value increases due to changes in excess air ratio beyond the processing capacity of the CO oxidation catalyst member 27 is eliminated, thus producing an effect that a stable CO reduction can be achieved. In particular, for a $NO_x$ reduction means of which the $NO_x$ reduction target value is not more than 10 ppm, involving an abrupt increase of the exhaust CO value at around 10 ppm, the constant excess-air-ratio control produces quite a large effect in terms of the achievement of a CO reduction target value and the facilitation of the capacity design of the CO oxidation catalyst member 27.

The facilitation of the capacity design of the CO oxidation catalyst member 27 is further explained. The CO oxidation catalyst member 27, in which pressure loss increases with increasing capacity, is so designed that the CO reduction target value can be satisfied just at the very limit. Without the constant excess-air-ratio control, there would arise a need for designing the processing capacity of the CO oxidation catalyst member 27 with a margin. Meanwhile, with the processing capacity increased, the pressure loss would increase. As a result, the pressure loss of the steam boiler itself would increase, giving rise to a need for redesigning the blower 4 or the boiler body 3. Performing the constant excess-air-ratio control produces, as in this working example, has an effect of solving these problems.

Further, in the low combustion state, although the heat-transfer-tube removal space 31 does not function effectively as CO reduction means, yet CO is oxidized by the CO oxidation catalyst member 27, so that CO reduction can be fulfilled regardless of whether it is in the high combustion state or the low combustion state.

It is noted that the present invention is not limited to the above-described working example, and includes the following modified examples. The first suppression means is provided as a fully-premixing type gas burner in the above working example, but it may also be provided as a partially-premixing type burner in another embodiment.

Also, although the heat transfer tubes 2 of the second suppression means are implemented by vertical water tubes in the foregoing working example, yet the heat transfer tubes 2 may also be implemented by water tubes which are positioned horizontal or tilted. Further, the shape of the heat transfer tubes 2 is also not limited to a perfect circle of the foregoing working example, and may be shaped into elliptical or other shapes in another embodiment.

Also, the heat transfer tubes 2 of the second suppression means are provided as bare tubes in the foregoing working example. However, it is also possible that some of the heat transfer tubes 2 in the downstream of the heat-transfer-tube removal space 31 may be fitted with horizontal fillet-like fins or full-peripheral fins (not shown either) so that the heat recovery rate can be enhanced, in another embodiment.

Figure 8:
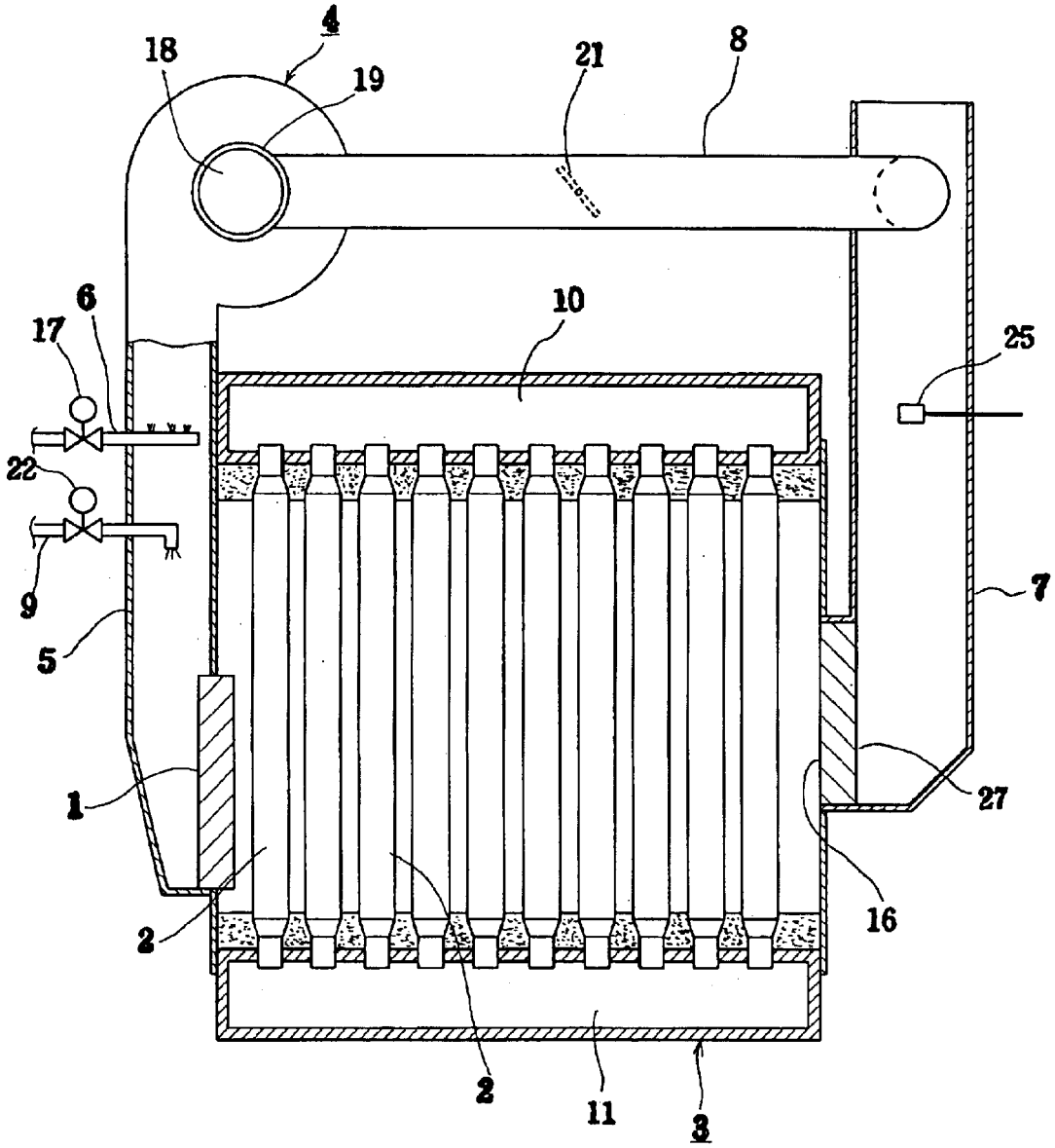
FIG. 8 is an explanatory view of a longitudinal section of a steam boiler of another embodiment of the present invention which is equipped with a fourth suppression means.

Also, steam of the steam addition tube 9 of the fourth suppression means is jetted out into the air inlet passage 19 in the foregoing working example. Otherwise, in another embodiment, the steam addition tube 9 may be attached so as to jet out steam to between the burner 1 and the blower 4 as shown in FIG. 8. According to this modified example, since steam is fed in the downstream of the blower 4, the increase in the blow load of the blower 4 can be lessened as compared with the foregoing working example in which steam is fed on the upstream side, while the blower 4 can be prevented from corrosion due to condensations.

Figure 9:
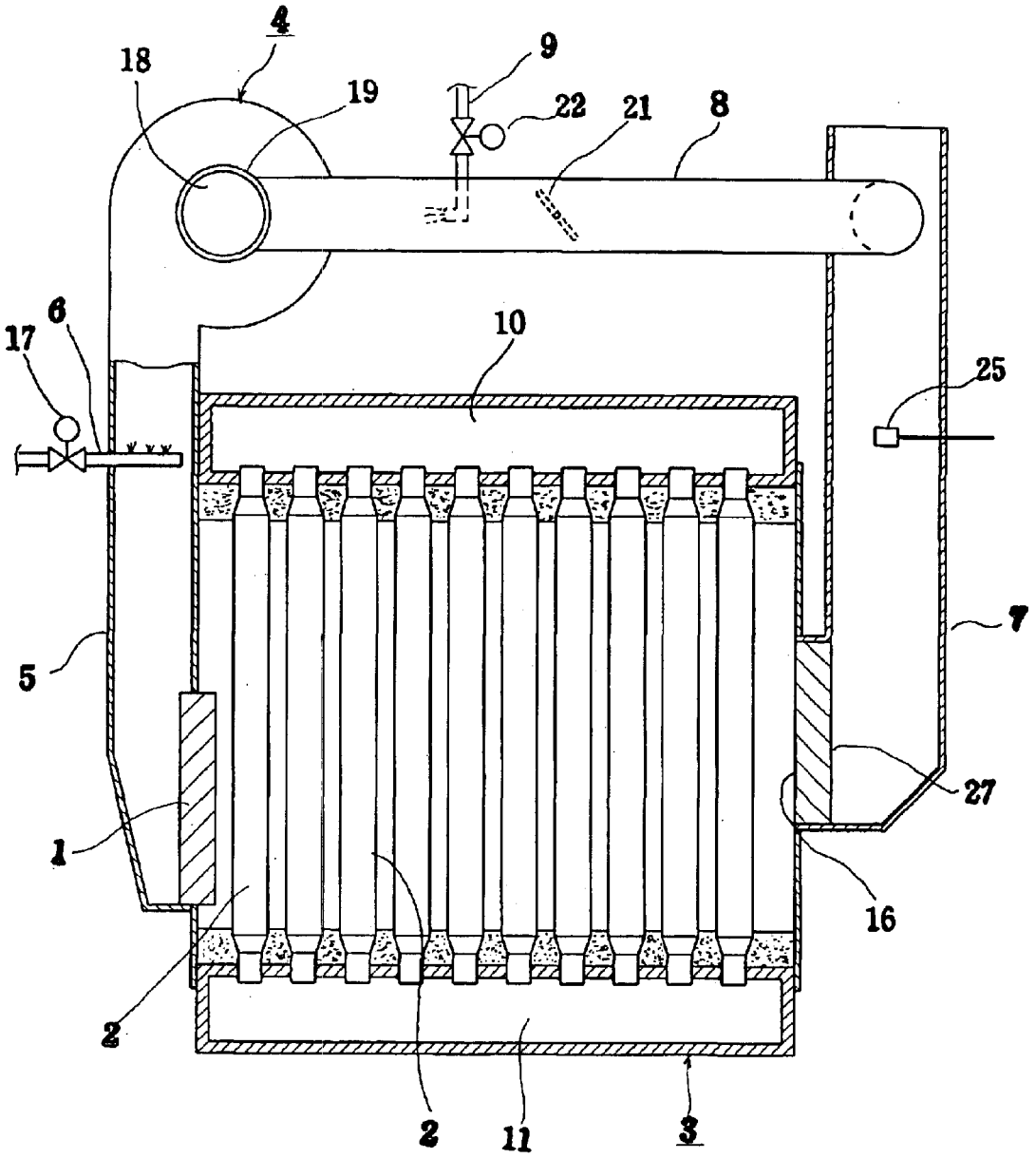
FIG. 9 is an explanatory view of a longitudinal section of a steam boiler of another embodiment of the present invention which is equipped with a fourth suppression means.

Also, in another embodiment, the steam addition tube 9 may be attached so as to jet out steam to the exhaust-gas recirculation passage 8 as shown in FIG. 9. Jetting out steam to the exhaust-gas recirculation passage 8 makes condensations less likely to occur, thus producing effects such as less occurrence of rust, uniformized mixing of steam and combustion-use air, and the like.

Figure 10:
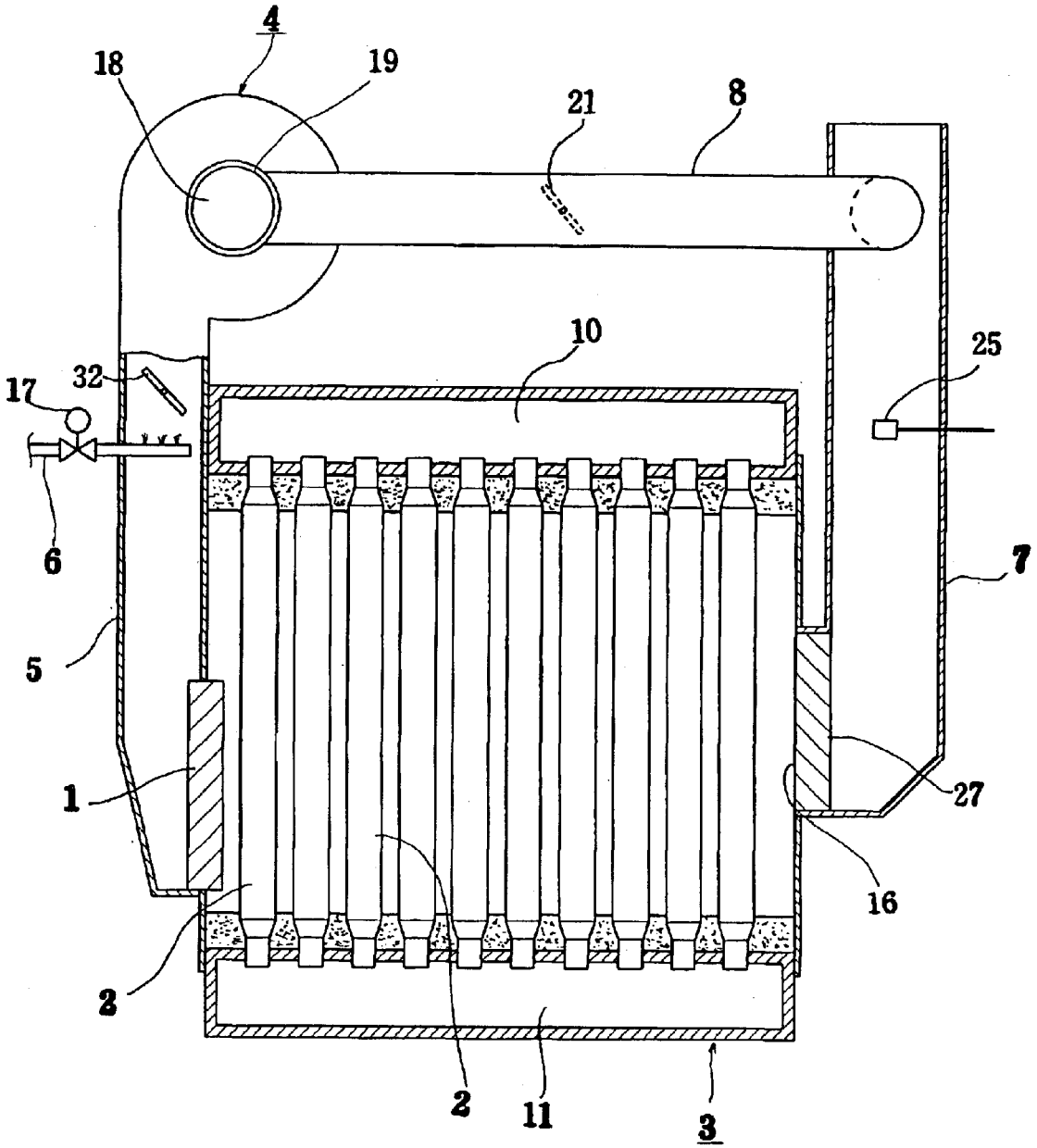
FIG. 10 is an explanatory view of a longitudinal section of a steam boiler of another embodiment of the present invention which is equipped with an excess-air-ratio control means.

Also, the excess-air-ratio control means is designed to control the rotational speed of the blower 4 in the foregoing working example. However, it is also possible, in another embodiment, that the excess air ratio is controlled by a second damper 32 as a combustion-air flow rate adjusting means provided on the downstream side of the blower 4, as shown in FIG. 10.

Figure 11:
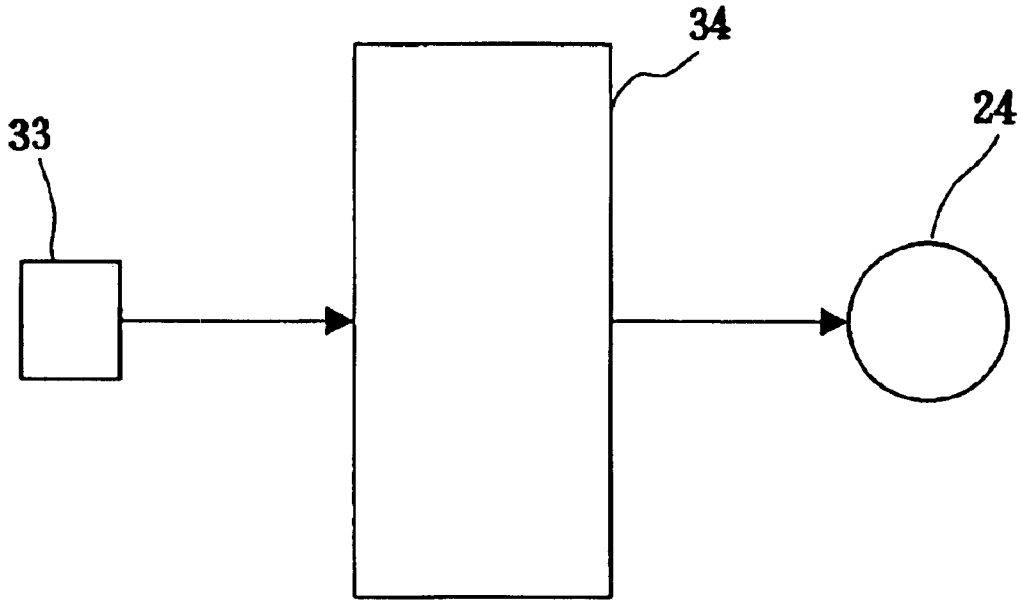
FIG. 11 is a main-part control circuit diagram of an excess-air-ratio control means of another embodiment of the present invention.

Also, the excess-air-ratio control means is controlled by a signal of the oxygen concentration sensor 25 in the foregoing working example. However, in another embodiment, it is also possible that an outside-air temperature sensor 33 as the outside-air temperature detection means for detecting the intake air temperature of the blower 4 is provided, where the excess air ratio is controlled by an output of this outside-air temperature sensor 33 as shown in FIG. 11. In this case, with a specified combustion rate and a specified exhaust-gas recirculation quantity, the relationship between outside-air temperature and excess air ratio is preliminarily determined by experiments, and a correlation table (not shown) of outside-air temperature versus rotational speed of the blower is prepared. Then, with this correlation table stored in a memory of a control circuit 34 (not shown), the electric motor 24 of the blower 4 may be controlled based on this table so that the excess air ratio is maintained generally constant.

Figure 12:
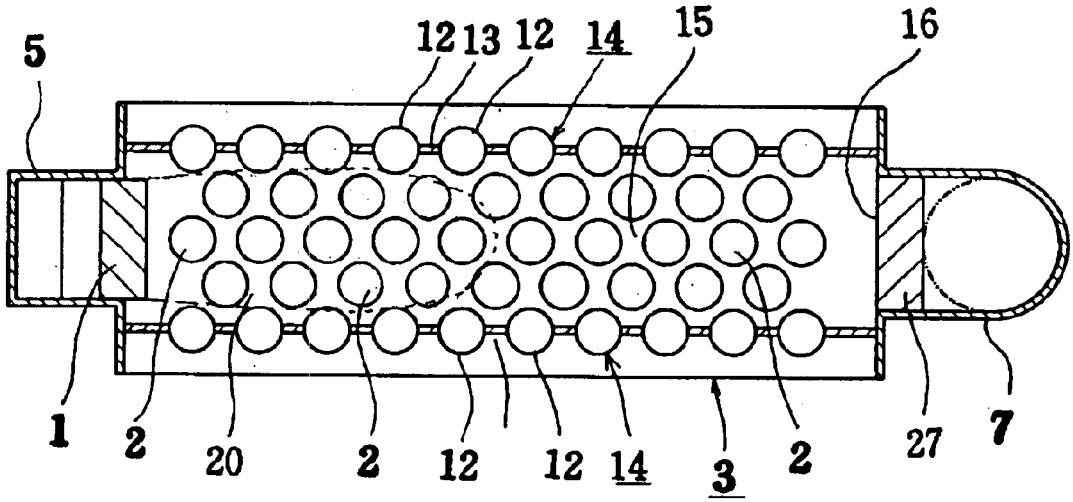
FIG. 12 is a sectional explanatory view of another embodiment of the present invention, corresponding to FIG. 2.

Also, the heat-transfer-tube removal space 31 is included in the $NO_x$ reduction means in the foregoing working example. Otherwise, in another embodiment, it is also possible that the heat-transfer-tube removal space 31 is omitted, i.e., none of the heat transfer tubes 2 are removed, as shown in FIG. 12.

Also, the steam boiler of the foregoing working example is switchable between combustion quantities of high combustion and low combustion. However, the steam boiler may also be a steam boiler without the switching of combustion quantity, in another embodiment.

Further, the CO oxidation catalyst member 27 is attached at the exhaust gas outlet 16 in the foregoing working example. However, in the case where a feed water preheater (economizer) (not shown) is provided on the exhaust gas passage 7, the CO oxidation catalyst member 27 may also be disposed on the upstream side of the feed water preheater in the chamber in which the feed water preheater is contained.

According to the present invention, $NO_x$ reduction can be facilitated without taking into consideration the generation of CO, and yet such a $NO_x$ reduction that the value of exhaust $NO_x$ falls under 10 ppm can be easily achieved while CO reduction can be achieved at the same time. Thus, the invention is capable of providing techniques and commodities of low pollution adapted to the needs of the times, hence being of great industrial value.

What is claimed is:

1. A combustion method for $NO_x$ reduction by suppressing temperature of combustion gas derived from a burner, comprising the steps of:

reducing $NO_x$ by suppressing combustion gas temperature in such a manner that suppression of $NO_x$ generation is preferred to reduction of exhaust CO value, thereby keeping $NO_x$ value not more than 10 ppm at 0% $O_2$, in the exhaust gas, dry basis; and thereafter reducing exhaust CO value resulting from the $NO_x$ reduction step to not more than a specified value.

2. A combustion method for $NO_x$ reduction as claimed in claims 1, wherein the $NO_x$ reduction step is performed with an excess air ratio which is determined from a $NO_x$ reduction target value and an excess air ratio versus $NO_x$ characteristic of the $NO_x$ reduction step.

3. A combustion method for $NO_x$ reduction by suppressing temperature of combustion gas derived from a burner, comprising:

a $NO_x$ reduction step for suppressing combustion gas temperature in such a manner that suppression of $NO_x$ generation is preferred to reduction of exhaust Co value, thereby keeping $NO_x$ value not more than a specified value; and a CO reduction step for thereafter reducing exhaust CO value resulting from the $NO_x$ reduction step to not more than a specified value;

wherein the CO reduction step is performed with a CO oxidation catalyst member.

4. A combustion method for $NO_x$ reduction by suppressing temperature of combustion gas derived from a burner, comprising: a $NO_x$ reduction step for suppressing combustion gas temperature in such a manner that suppression of $NO_x$ generation is preferred to reduction of exhaust CO value, thereby keeping $NO_x$ value not more than 10 ppm at 0% $O_2$ in the exhaust gas, dry basis; and a CO reduction step for thereafter reducing exhaust CO value resulting from the $NO_x$ reduction step to not more than a specified value.

5. A combustion method for $NO_x$ reduction as claimed in claims 4, wherein the $NO_x$ reduction step is performed with an excess air ratio which is determined from a $NO_x$ reduction target value and an excess air ratio versus $NO_x$ characteristic of the $NO_x$ reduction step.

6. A combustion method for $NO_x$ reduction as claimed in claims 4, wherein the CO reduction step is performed with a CO oxidation catalyst member.

7. A combustion method for $NO_x$ reduction by suppressing temperature of combustion gas derived from a burner, comprising the steps of: reducing $NO_x$ product ion by suppressing combustion gas temperature in such a manner that suppression of $NO_x$ generation is preferred to reduction of exhaust CO value, thereby keeping $NO_x$ value not more than 10 ppm at 0% $O_2$ in the exhaust gas, dry basis; and thereafter reducing exhaust CO value resulting from the $NO_x$ reduction step to not more than a specified value, the CO reduction step being performed in a zone where the combustion gas temperature is not more than 900° C.

8. A combustion method for $NO_x$ reduction as claimed in claims 7, wherein the $NO_x$ reduction step is performed with an excess air ratio which is determined from a $NO_x$ reduction target value and an excess air ratio versus $NO_x$ characteristic of the $NO_x$ reduction step.

9. A combustion method for $NO_x$ reduction by suppressing temperature of combustion gas derived from a burner, comprising: a $NO_x$ reduction step for suppressing combustion gas temperature in such a manner that suppression of $NO_x$ generation is preferred to reduction of exhaust CO value, thereby keeping $NO_x$ value not more than a specified value; and a CO reduction step for thereafter reducing exhaust CO value resulting from the $NO_x$ reduction step to not more than a specified value, the CO reduction step being performed in a zone where the combustion gas temperature is not more than 900° C.;

wherein the CO reduction step is performed with a CO oxidation catalyst member.

10. A combustion apparatus for $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than a specified value; and CO reduction means for reducing exhaust CO value resulting from the $NO_x$ reduction means to not more than a specified value.

11. A combustion apparatus for $NO_x$ reduction as claimed in 10, wherein the $NO_x$ reduction is performed with an excess air ratio which is determined from a $NO_x$ reduction target value and an excess air ratio versus $NO_x$ characteristic of the $NO_x$ reduction means.

12. A combustion apparatus for $NO_x$ reduction as claimed in claims 10, wherein the CO reduction means is a CO oxidation catalyst member.

13. A combustion apparatus for $NO_x$ reduction as claimed in claims 10, wherein the $NO_x$ reduction means is implemented by heat transfer tubes having a space formed by removing heat transfer tubes.

14. A combustion apparatus for $NO_x$ reduction as claimed in claims 10, wherein the $NO_x$ reduction means is implemented by heat transfer tubes having no space formed by removing heat transfer tubes.

15. A combustion apparatus for $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than 10 ppm at 0% $O_2$ in the exhaust gas, dry basis; and CO reduction means for reducing exhaust CO value resulting from the $NO_x$ reduction means to not more than a specified value.

16. A combustion apparatus for $NO_x$ reduction by suppressing temperature of combustion gas derived from a burner, comprising: $NO_x$ reduction means for suppressing combustion gas temperature in such a manner that suppression of $NO_x$ generation is preferred to reduction of exhaust CO value, thereby keeping $NO_x$ value not more than a specified value; and CO reduction means for reducing exhaust CO value resulting from the $NO_x$ reduction means to not more than a specified value in a zone where the combustion gas temperature is not more than 900° C.

17. A combustion apparatus for reducing $NO_x$ production by suppressing combustion gas temperature, comprising:

a boiler body;

an exhaust gas passage;

an exhaust gas recirculating passage directing exhaust gas from said exhaust gas passage into said boiler body to reduce combustion gas temperature in such a manner that suppression of $NO_x$ generation is preferred to reduction of exhaust CO value, thereby keeping $NO_x$ value not more than a specified value; and a CO oxidation catalyst member.

18. A combustion apparatus for reducing $NO_x$ production by suppressing combustion gas temperature, comprising:

a boiler body including a burner;

an air inlet passage providing air to said burner;

a steam addition tube introducing steam to said air inlet passage to reduce combustion gas temperature in such a manner that suppression of $NO_x$ generation is preferred to reduction of exhaust CO value, thereby keeping $NO_x$ value not more than a specified value; and a CO oxidation catalyst member.

* * * * *